US008701614B2

(12) United States Patent
Cassani

(10) Patent No.: US 8,701,614 B2
(45) Date of Patent: Apr. 22, 2014

(54) GLOWPLUG TEMPERATURE ESTIMATION METHOD AND DEVICE

(75) Inventor: Stefano Cassani, Linkoping (IT)

(73) Assignee: GM Global Technology Operations LLC, Detroit, MI (US)

( * ) Notice: Subject to any disclaimer, the term of this patent is extended or adjusted under 35 U.S.C. 154(b) by 917 days.

(21) Appl. No.: 12/859,188

(22) Filed: Aug. 18, 2010

(65) Prior Publication Data

US 2011/0041785 A1 Feb. 24, 2011

(30) Foreign Application Priority Data

Aug. 19, 2009 (GB) ..... 0914478.3

(51) Int. Cl.
*F23Q 7/00* (2006.01)
*F23Q 13/00* (2006.01)

(52) U.S. Cl.
USPC ..... 123/145 A; 361/266; 219/264

(58) Field of Classification Search
USPC ..... 123/145 R, 145 A, 543, 549; 361/264, 361/266; 73/114.58, 114.62; 701/101, 102, 701/106, 110, 111; 219/260, 262, 264, 270
See application file for complete search history.

(56) References Cited

U.S. PATENT DOCUMENTS

| | | | | |
|---|---|---|---|---|
| 4,658,772 | A * | 4/1987 | Auth et al. | 123/145 A |
| 5,195,886 | A * | 3/1993 | Ida | 431/30 |
| 5,664,540 | A * | 9/1997 | Matsuoka et al. | 123/254 |
| 8,217,310 | B2 * | 7/2012 | Sakurai | 219/268 |
| 2001/0050275 | A1 * | 12/2001 | Uhl | 219/270 |
| 2004/0255889 | A1 * | 12/2004 | Kumada et al. | 123/179.6 |
| 2009/0200286 | A1 * | 8/2009 | Reissner | 219/264 |
| 2009/0294431 | A1 * | 12/2009 | Sakurai | 219/268 |
| 2011/0041785 | A1 * | 2/2011 | Cassani | 123/41.32 |

FOREIGN PATENT DOCUMENTS

| | | | |
|---|---|---|---|
| EP | 1719909 | A1 | 11/2006 |
| EP | 2123901 | A1 | 11/2009 |
| JP | 2009168319 | A | 7/2009 |
| WO | 2009097920 | A1 | 8/2009 |

* cited by examiner

*Primary Examiner* — Stephen K Cronin
*Assistant Examiner* — Sherman Manley
(74) *Attorney, Agent, or Firm* — Ingrassia Fisher & Lorenz, P.C.

(57) ABSTRACT

A method is provided for controlling one or more glowplugs in a compression-ignition engine. The controlling of the glowplug involves the prediction of a glow plug temperature to control a power supply to the glowplug. A supplied power to a glowplug and a combustion chamber temperature is determined. A temperature of the glowplug is predicted and the predicted glowplug temperature is used to control a power supply to the glowplug. The predicted glowplug temperature is derived from a numerical solution of a differential equation for the glowplug temperature. The differential equation is nonlinear in the glowplug temperature.

18 Claims, 4 Drawing Sheets

GLOWPLUG TEMPERATURE ESTIMATION METHOD AND DEVICE

CROSS-REFERENCE TO RELATED APPLICATION

This application claims priority to British Patent Application No. 0914478.3, filed Aug. 19, 2009, which is incorporated herein by reference in its entirety.

TECHNICAL FIELD

The technical field generally relates to glow plugs and more particularly to a glowplug temperature estimation method and device.

BACKGROUND

Compression-ignition engines are typically equipped with a glowplug system. The glowplug system provides a general combustion aid during engine ignition and also during a warm-up phase of the running engine. A key component of this system is the glowplug whose tip can rise up to high temperatures of above 900° C. by means of an electrical to thermal power conversion.

Each cylinder is equipped with one glowplug which is turned on when needed on the base of engine and environmental conditions, typically in cold conditions. Glowplugs function as electrical resistors. Their resistance varies with temperature. As the temperature increases, the internal resistance increases, too.

Different technologies for glowplugs are in use. Glowplugs may be high or low voltage and they may be of different materials, such as metallic or ceramic glowplugs. High voltage glowplugs are typically supplied directly by a vehicle battery. Low voltage glowplugs in contrast, as they have a nominal voltage lower than the battery voltage, typically need a pulse width modulation (PWM) supply to get the correct voltage. Especially the low voltage glowplugs can be controlled easily by connecting the gates of MOSFETS of the PWM to an electronic control unit and controlling the duty cycle of the PWM.

SUMMARY

The application discloses a method for controlling one or more glowplugs in a compression-ignition engine for execution on a computer, a microcontroller or the like. The controlling of the glowplug involves the prediction of a glow plug temperature to control a power supply to the glowplug. Specifically, the power supply can be controlled by controlling the puls width of a pulse width modulation.

According to the application, a supplied power to a glowplug and a combustion chamber temperature is determined. Determination of the supplied power comprises reading in an input value of the supplied power or reading in of input values from which the supplied power is derived, as for example a pulse width of a pulse width modulation or a supplied voltage. Determination of the combustion chamber temperature comprises reading in an input value of the combustion chamber temperature or reading in of input values from which the combustion chamber temperature is derived.

Those input values may comprise, among others, engine load, engine speed, cooling water temperature and intake air temperature.

A temperature of the glowplug is predicted and the predicted glowplug temperature is used to control a power supply to the glowplug. The power supply may be controlled, for example, by opening and closing MOSFETs or other types of transistors or by opening and closing glowplug relays.

The predicted glowplug temperature is derived from a numerical solution of a differential equation for the glowplug temperature. The differential equation is nonlinear in the glowplug temperature in the sense that the differential equation comprises a power of the glowplug temperature which is greater than one. In particular, a differential equation is disclosed which comprises a fourth power of the glowplug temperature for modelling a radiative heat transfer. A derivation of the glowplug temperature comprises the insertion of input values or computed values in to an equation or into a set of equations which represent the numerical solution of the differential equation.

In an alternative embodiment, predicting of the glowplug temperature comprises resetting the predicted glowplug temperature to a second estimate if the second estimate differs by more than a predetermined amount from a first estimate which is derived from the numerical solution of the differential equation.

According to the application, a differential equation for the glowplug temperature is derived from a power balance equation—or an equivalent energy balance equation. The power balance equation comprises at least four terms Pg, Pi, Pe, Pc, wherein Pg models a supplied power to the glow plug, Pi models an energy stored in the glow plug per unit of time, Pe models a radiation energy per unit of time, Pc models a heat energy per unit of time, the heat energy being transferred by convection or conduction. "Derived" in this context means that there is an equation which is equivalent to the differential equation in which the terms Pg, Pi, Pe, Pc occur.

According to the application, a differential equation for the glowplug temperature takes the form $Pg(t)=A*d/dt\ Tg(t)+B*Tg(t)+C*Tg(t)^4+D(t)$ wherein Pg is the supplied energy to the glowplug, Tg is the glowplug temperature, A, B, C are derived from precalibrated values and D(t) is a function of a combustion chamber temperature. A, B, C are derived from precalibrated values in the sense that they are determined on the basis of input values and precalibrated characteristic curves or that they are precalibrated constants.

According to the application, the power supply to the glowplug may be controlled in various ways. For example, it may be controlled by controlling the opening time of a glowplug relay or by controlling the opening time of a transistor. The opening time of the transistor may be controlled by a pulse width modulation (PWM). Especially by using a PWM controlled transistor, the glowplug can be easily controlled by a digital controller.

Furthermore, the application discloses a device for controlling a glowplug temperature by the aforementioned method which comprises means to predict a glowplug temperature from at least a supplied power to the glowplug and a combustion chamber temperature. In one embodiment of the application, the means are provided by a mode programming unit, a logic unit and a gate drive unit. The device further comprises means to derive the combustion chamber temperature, either by reading in an input value or by computing the combustion temperature from input values. In one embodiment of the application, the means are provided by an input 26 which is connected to an engine control unit.

The device comprises means to derive an amount of transferred heat energy which transferred by radiation transfer between the glowplug and the combustion chamber. In one embodiment of the application, the means are provided by programmed instructions in a logic unit of the device. The device further comprises means to derive a temperature control value for a glowplug temperature from the predicted glowplug temperature. In one embodiment of the application, the means are provided by a controller in a logic unit of the device. The controller uses the predicted glowplug temperature and a desired glowplug temperature as input values. The device also comprises means to compute a pulse width of a pulse width modulation from the temperature control value. In an embodiment of the application, the means are provided by a gate drive unit.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit application and uses. Furthermore, there is no intention to be bound by any theory presented in the preceding background or summary or the following detailed description. Moreover, in the following description, details are provided to describe the embodiments of the application (invention). It shall be apparent to one skilled in the art, however, that the embodiments may be practised without such details.

Figure 1:
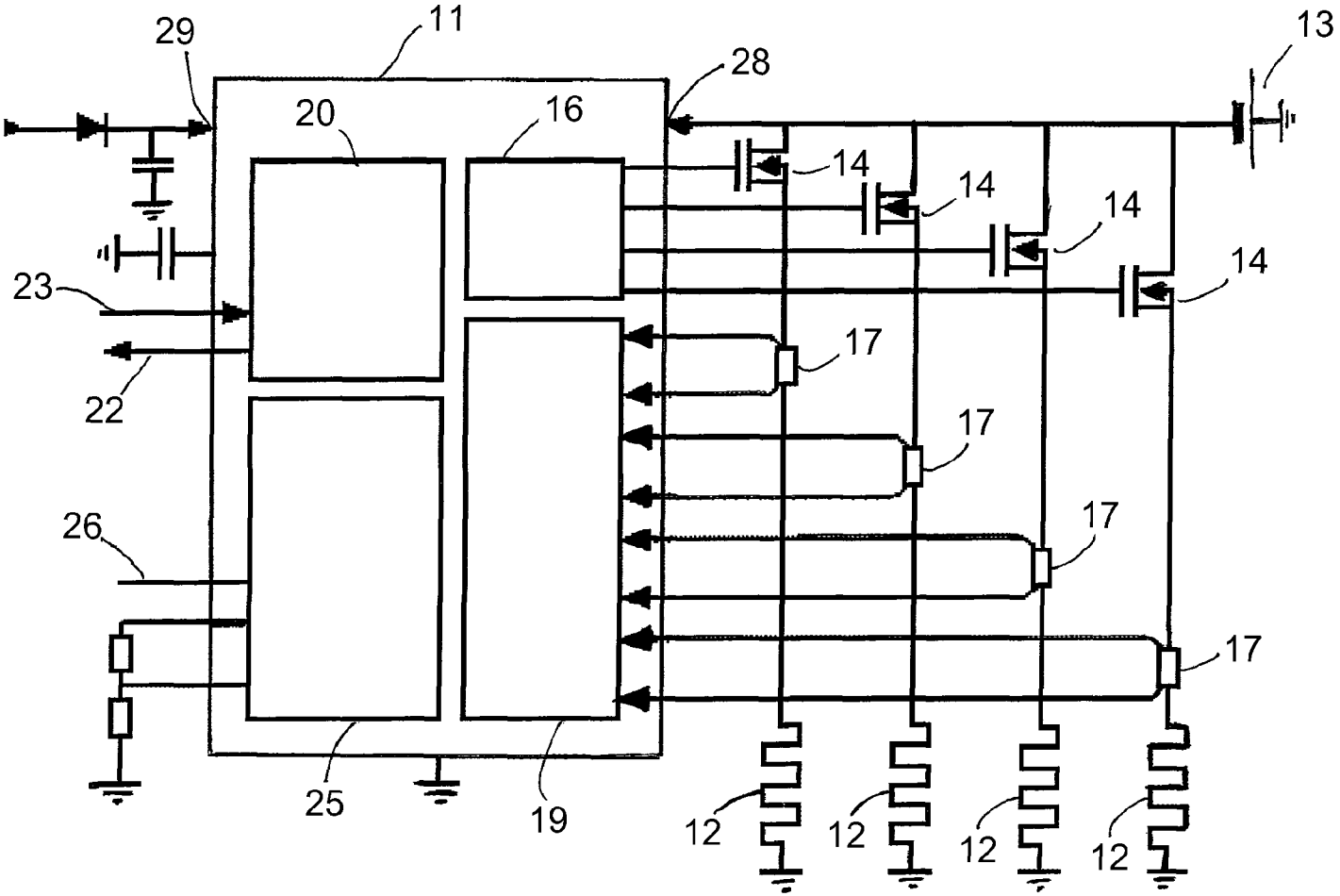
FIG. 1 illustrates a glowplug control device and controlled glowplugs.

FIG. 1 shows a glowplug control device 11 for electric glowplugs 12 which are symbolized by heating coils. The glowplugs 12 are connected to a power supply 13 via field effect transistors (MOSFETS) 14. A gate of each of the MOSFETS 14 is connected to a corresponding output of a gate drive unit 16 within the glowplug control device 11. Sense resistors 17 are provided between the drain of each MOSFET 14 and the corresponding glowplug 12. An input and an output of each of the sense resistors 17 is connected to a corresponding output and a corresponding input of a diagnosis unit 19 within the glowplug control device 11.

The glowplug control device 11 further comprises a logic unit 20 which in turn comprises a diagnostic logic and a control logic. A diagnosis output 22 of the logic unit 20 is connected to an engine control unit (ECU) which is not shown. A control input 23 of the logic unit 20 is connected to the ECU. Furthermore, the glowplug control device 11 comprises a mode programming unit 25. The mode programming unit 25 is connected to sensor outputs via an input 26. A voltage sensing input 28 of the glowplug control device 11 is connected to the power supply 13 and a power input 29 of the glowplug control device 11 is connected to a supply voltage.

During operation, the logic unit 20 receives control input from the ECU via control input 23 and the mode programming unit 25 receives sensor values via the input 26. Based on the sensor values the mode programming unit 25 determines an operation mode and sends output values to the logic unit 20. The sensor values may include, among others, the engine coolant or cooling water temperature, the engine speed, the injected fuel, the output torque of the engine. The ECU makes use of a suitable model to derive a combustion chamber temperature from sensor values and provides the derived combustion chamber temperature at the input 26. The ECU may also provide further information to the glowplug control device 11, for example the length of a previous idle phase of the engine motor.

The control logic of the logic unit 20 computes a desired effective voltage for each of the glowplugs 12 which is based on the input values to the glowplug control device 11. The gate drive unit 16 uses the desired effective voltages to compute a length of a duty cycle of a pulse width modulation for each of the glowplugs 12 and controls the gates of the MOSFETS 14 according to the duty cycle.

Via the inputs and outputs to the sense resistors 17, the diagnosis unit 19 derives a voltage drop for each of the sense resistors 17. From the voltage drops, the diagnostic unit derives supply currents for each of the glowplugs 12. The diagnostic unit 19 provides the values of the derived supply currents to the mode programming unit 25. Furthermore, the diagnostic unit 19 generates an error condition if the derived supply current is higher or lower than specified boundary values.

Figure 2:
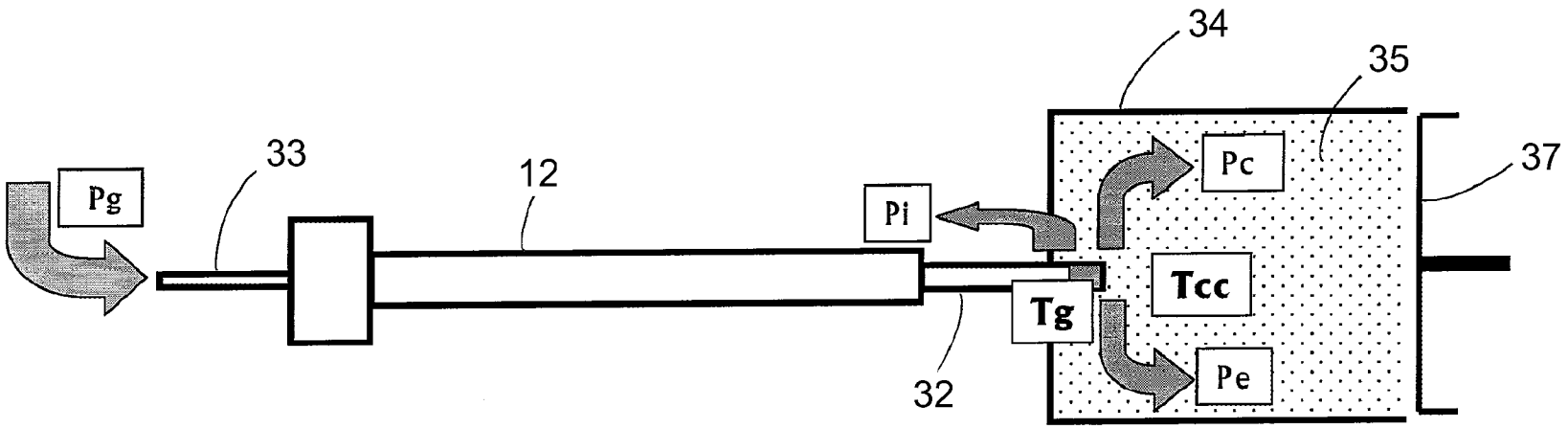
FIG. 2 illustrates a schematic diagram which shows energy flows in a combustion chamber.

FIG. 2 shows energy conversion processes in a combustion chamber of a combustion engine which is not shown here. A tip 32 of a glowplug 12 extends into a combustion chamber 34. A heating coil and a regulating coil which are not shown are provided inside the tip 32 of the glowplug 12. At the upper end of the glowplug 12 a terminal 33 for the supply current is provided. The combustion chamber 34 comprises a fuel air mixture 35 which is supplied to the combustion chamber 34 by an injection valve that is not shown. A movable piston 37 is located within the combustion chamber 34 at the opposite side of the glowplug 12.

During operation of the glowplug 12, electric energy is supplied to the glowplug 12 with the storing power Pg via the terminal 33. The storing power Pg is converted to a storing power Pi of the glowplug 12, to a heating power Pc which accounts for heat transfer by convection and conduction and to a heating power Pe which accounts for heat transfer by radiation. This results in the following power balance equation $$Pg=Pi+Pc+Pe \tag{1}$$

At this level of modelling, loss of heat energy to the exterior and also energy loss/gain by the action of the piston 37 is neglected. Arrows in FIG. 2 symbolize the four terms Pg, Pi, Pc, Pe of the power balance equation.

Figure 3:
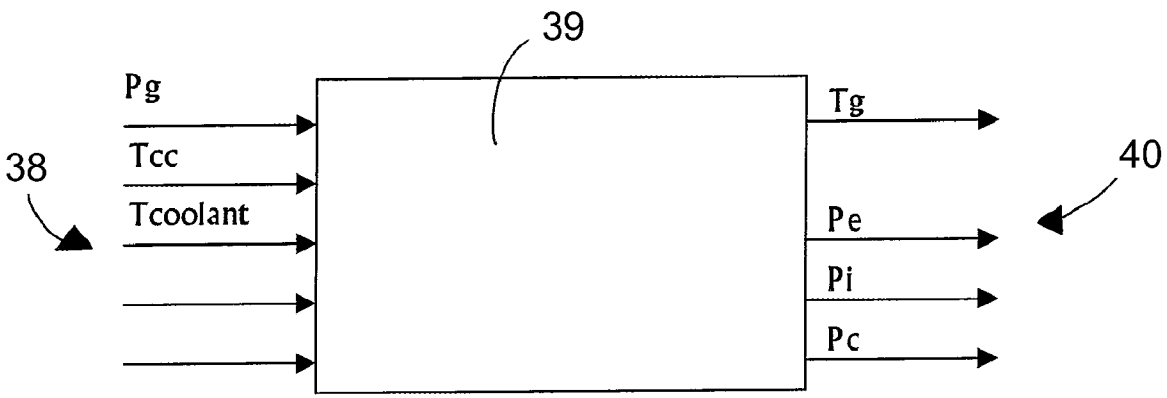
FIG. 3 illustrates input and output values of a computational technique for a glowplug.

FIG. 3 shows input values 38 on the left side of a box 39 and it shows predicted values 40 to the right of the box 39. The box 39 symbolizes a data transformation. Input values 38 include the supplied electrical power Pg, the combustion chamber temperature Tcc, which is usually computed by the ECU, and the temperature of the coolant Tcoolant. Predicted output values 40 include the glowplug temperature Tg, the transferred radiation power Pe, the transferred heating power Pc by conduction and convection, the internal storing power Pi.

Figure 4:
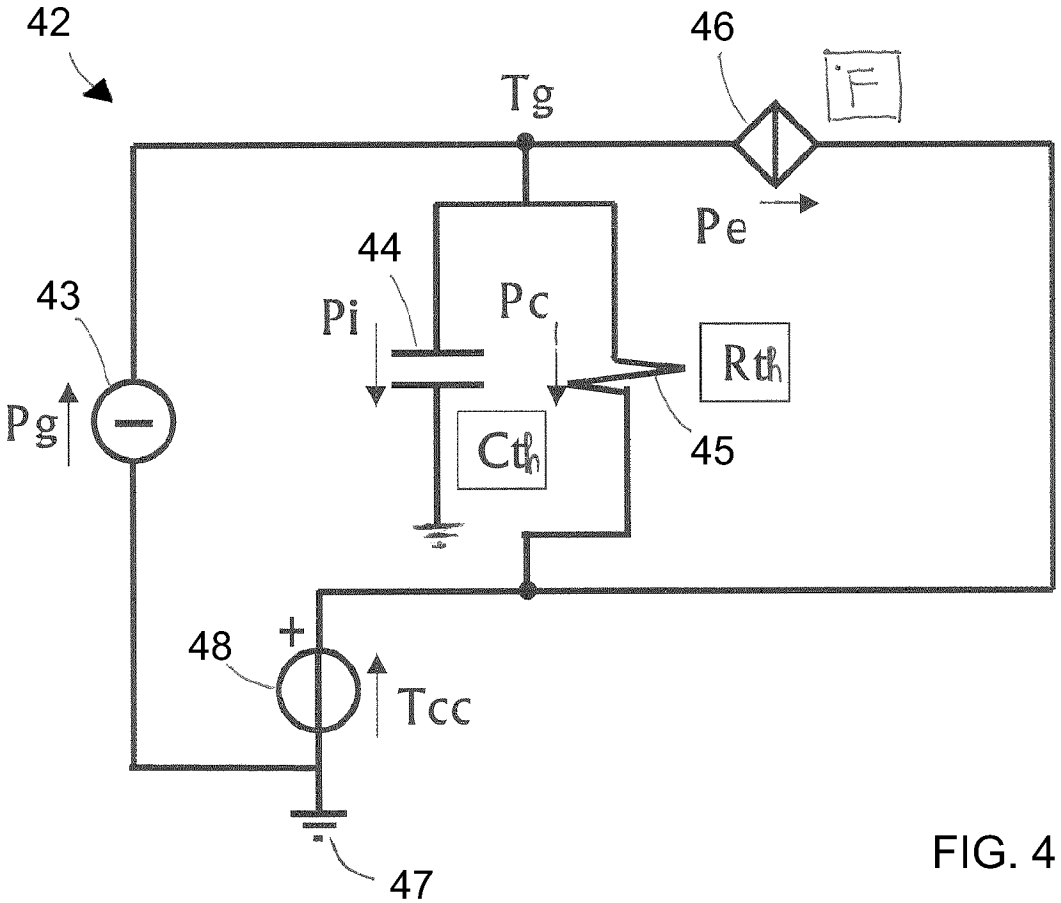
FIG. 4 illustrates an equivalent circuit diagram of the computation technique of FIG. 3.

FIG. 4 shows an equivalent circuit diagram 42 which provides an analog model of the four terms Pg, Pi, Pc, Pe of the above power balance equation (1) for one of the glowplugs 12. Model parameters Rth, Cth and F are shown within boxes. Within the scope of this model, power terms are modelled as electrical currents and temperatures are modelled as electrical voltages relative to a ground level 47. Specifically, the power supply of the glowplug is modelled by a current source 43. The internal storage of heat in the glowplug is modelled by a capacitor 44 with a capacity Cth. The heat transfer from the glowplug by conduction and convection is modelled by resistor 45 with a resistance Rth. The radiation transfer from the glowplug to the combustion chamber is modelled by a controlled current source 46 which is driven in the same sense as the current source 43. The output of the controlled current source 46 depends on the model parameter F. The combustion chamber temperature is modelled by a controlled voltage source 48.

The glowplug temperature Tg is modelled as a voltage which is measured at a reference point between voltage source 43 and the inputs of capacitor 44 and resistor 45 relative to the ground level 47. The Resistor 45 and controlled current source 46 are connected in parallel between current source 43 and controlled voltage source 48. Capacitor 44 is connected between the current source 43 and the ground 47.

This analog model can be provided by a circuitry which is not shown here. The current sources 46, 48 can be provided by custom made components.

In accordance with the equivalent circuit diagram 42, the computational digital model is determined by the equations (1) and:

$$Pg=V\text{peak}*I\text{peak}*D \tag{2}$$

$$Pi=Cth*d/dtTg \tag{3}$$

$$Pc=(Tg-Tcc)/Rth \tag{4}$$

$$Pe=k_b*F*(Tg4-Tcc4) \tag{5}$$

According to equation (2), the power Pg that is supplied to the glowplug 12 is given by the voltage Vpeak times the current Ipeak times the length of the duty cycle. Herein, Vpeak and Ipeak are the voltage and the current at the glowplug during a square pulse of a duty cycle of the pulse width modulation. D is the length of the duty cycle relative to a period length of the pulse width modulation. The voltage Vpeak and current Ipeak at the glowplug are estimated by a current measurement at a sense resistor 17 and by the supply voltage to a MOSFET 14, respectively.

For a variable period length, the average power is given by:

$$Pg = \frac{1}{T}\int_0^T V(t)*I(t)dt \tag{2a}$$

Where T is a suitably chosen averaging time.

According to equation (3), the internal storing power Pi which is not directly converted into heating power is given by the thermal capacity Cth times the time derivative of the glowplug temperature Tg.

According to equation (4), the heating power Pc which is transferred to the fuel mixture in the combustion chamber by conduction and convection is given by the temperature difference between the temperature Tg of the glowplug and the temperature Tcc of the combustion chamber divided by the thermal resistance Rth of the conductive and convective heat transfer.

According to equation (5), the heating power Pe which is transferred to the fuel mixture in the combustion chamber by radiation is given by the Boltzmann constant k_b times a form factor F times the difference of the fourth powers of the glowplug temperature Tg and the temperature of the combustion chamber. Equation (5) gives the difference of the radiated energies of the glowplug and the combustion chamber according to the Stefan-Boltzmann equation.

The parameters Cth, Rth, F may be obtained by a calibration procedure with an instrumented plug at the production facility or at a repair shop. According to the application, the glowplug are modelled individually and separate parameters Cth, Rth, F are assigned to each glowplug. In an alternative embodiment only part of the glowplugs is modelled individually while another part of the glowplugs is modelled by using average values.

It is possible to solve the set of equations (1)-(5), for example, by inserting the right hand sides of (3), (4) and (5) into the balance equation (1). It follows a differential equation of the form:

$$Pg(t)=A*d/dtTg(t)+B*Tg(t)+C*Tg(t)^4+D(t) \tag{6}$$

for the glowplug temperature Tg.

The parameters A, B, C and D are known in terms of the parameters Rth, Cth and F and the time dependent temperature of the combustion chamber Tcc. Pg is known from equation (2) or equation (2a), respectively. Therefore, equation (6) can be solved numerically. From the computed glowplug temperature Tg, it is then possible to derive the terms Pi, Pe, Pc.

For example, the temperature T(t2) at a time t2 can be computed from values at an earlier time t1 by using the Euler method to solve equation (6). Other techniques like for example Runge-Kutta methods or linear multistep methods may also be used. In particular, the use of the Euler method results in the predicted glowplug temperature $$Tg(t_2) = Tg(t_1) + \frac{\Delta t}{A}*(Pg(t_1) - B*Tg(t_1) - C*Tg(t_1)^4 + D(t_1))$$

or $$Tg(t_2) = Tg(t_1) + \frac{\Delta t}{C_{th}}*\left(I*V*D_{PWM}(t_1) - \frac{1}{R_{th}}*Tg(t_1) - k_B F*Tg(t_1)^4\right) + \frac{\Delta t}{C_{th}}\left(\frac{1}{R_{th}}T_{cc}(t_1) + k_B F*T_{cc}(t_1)^4\right)$$

Herein, I is the current through the glowplug during a duty cycle, V is the estimated voltage drop across the glowplug during a duty cycle and D_PWM(t) is the duty cycle length at time t of a duty cycle at the transistor over which the glowplug is supplied. T_cc(t) is an estimate of the combustion chamber temperature which is derived by the ECU or by the glowplug control device 11 by making use of the engine coolant temperature and/or the engine load. The engine load may be derived from the fuel intake, the engine speed and the output torque, for example.

The thermal capacity C_th and the thermal resistance Rth and hence the parameters A and B may depend on time. In particular, the thermal resistance Rth depends on the combustion conditions. A more accurate model of the thermal resistance Rth would therefore model the thermal resistance Rth as a function of the engine speed and the engine load.

The temperature dependent resistance of the glowplug provides a second estimate of the glowplug temperature which may be used as an initial estimate of the glowplug temperature. The second estimate may also be used to correct the computed glowplug temperature in situations in which the solution of equation (6) drifts away from the actual glowplug temperature. This may be realized by resetting the estimated glowplug temperature to the second estimate if the difference between the estimated glowplug temperature and the second estimate exceeds a predefined limit.

If an estimate of the glowplug resistance is available, it may be used to eliminate either the current or the voltage in equation (2).

Equation (6) may also be used to predict a required input energy to reach a required temperature difference T(t2)−T(t1) within the time t2−t1.

One way to put a temperature estimation according to the above models into practice is to use the logic unit 20 for computing purposes. The glowplug temperature can then be controlled in the following manner. First the logic unit 20 generates an error signal by subtracting the estimated glowplug temperature Tg from a desired glowplug temperature which is supplied by the engine control unit at the input 23. Secondly the error signal is used as input signal to a controller, for example a PD, PID controller or the like to generate a control signal. The gate drive unit 16 uses the control signal to generate an input signal for a MOSFET 14 with a corresponding duty cycle.

A further method of using the above equations (1)-(5) is through a stored temperature and lookup tables which allow to to read out a predicted temperature as a function of a previous temperature and values of input parameters, like for example the combustion chamber temperature. Such a lookup table could be realized as a table that lists the predicted temperatures against all possible combinations of input parameters and previous temperatures.

Figure 5:
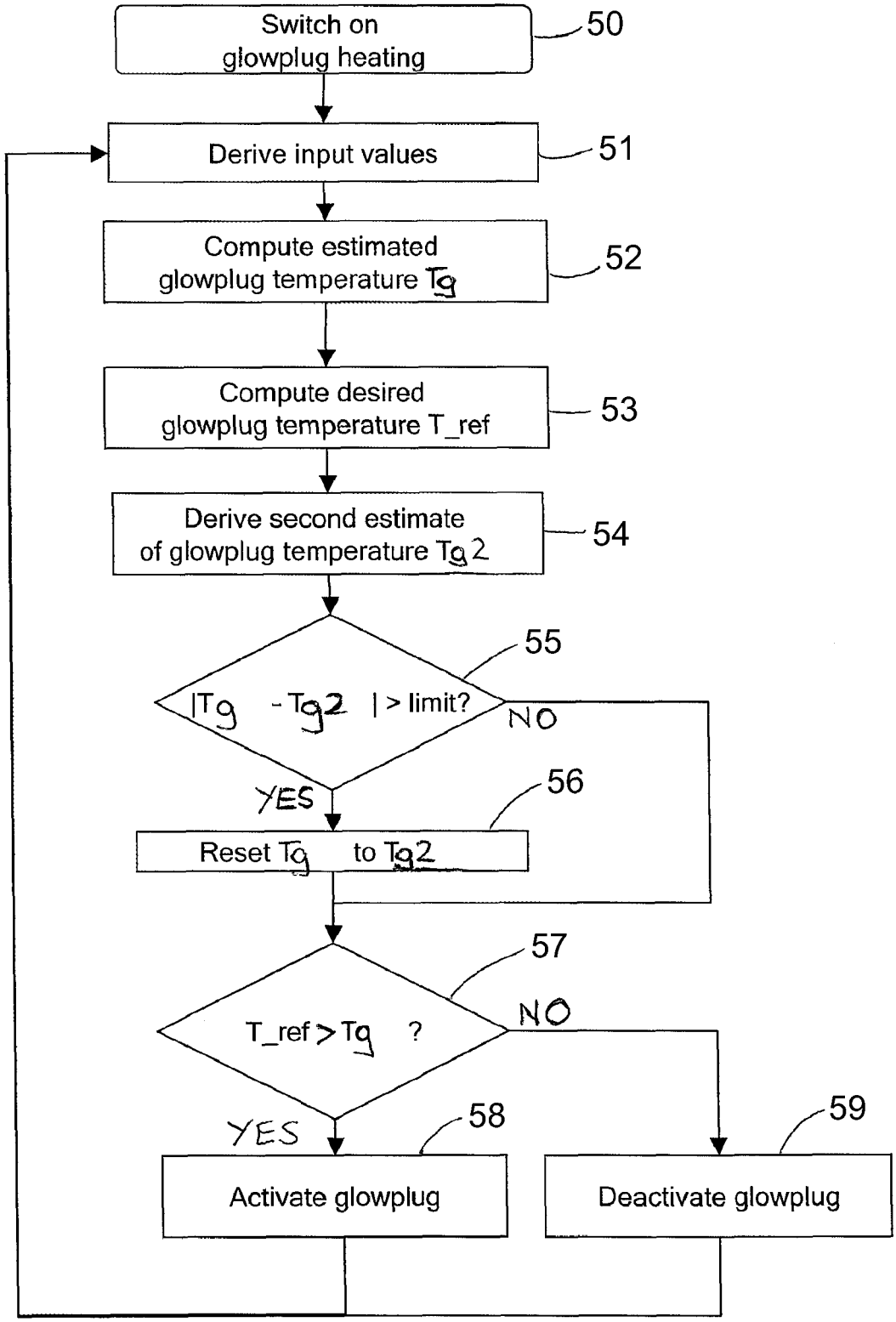
FIG. 5 illustrates a flow diagram for a glowplug control method.

FIG. 5 shows, by way of example, a flow diagram of a glowplug control method in which a glowplug temperature estimation method according to the application is used. The glowplug control method according to FIG. 5 may be implemented with a computer program or also with a hardwired circuit. Furthermore, a temperature estimation method according to the application may also be used for glowplug control methods other than the one which is shown in FIG. 5.

In a step 50, the glowplug heating is activated, for example by turning the key of a car. In a step 51, the input values for the temperature estimation technique are derived from sensor output values or from computations. The derivation of input values involves determining a supplied power to a glowplug and a combustion chamber temperature. In a further step 52, a glowplug temperature is predicted by computing a glowplug temperature estimate Tg according to the abovementioned temperature estimation technique. In a step 53, a desired glowplug temperature T_ref is computed. In a step 54 a second estimate Tg2 of the glowplug temperature is derived, based on the glowplug resistance. If, in decision step 55, it is found that the difference between the estimate Tg and the second estimate Tg2 of the glowplug temperature exceeds a predetermined limit, the estimate Tg is reset to the second estimate Tg2 in step 56. Otherwise, the estimate Tg is used as estimate for the glowplug temperature. In a decision step 57, it is tested whether the desired glowplug temperature T_ref is greater then the estimated glowplug temperature Tg. If this is the case, the glowplug is activated in step 58, otherwise it is deactivated in step 59. Next, the glowplug control method of FIG. 5 loops back to step 51 to derive of input values for the next time step.

The method of controlling the power supply to a glowplug according to steps 58, 59 may be refined further. For example, the temperature difference may be used as input to a PD controller to determine the duty cycle of a pulse width modulation. In an alternative glowplug control method, which is feed forward only, the steps 55, 56 are left out.

A temperature estimation method according to the application provides several advantages. The computation of the glowplug temperature according to the application avoids the use of a separate temperature sensor for each glowplug. Thereby, the cost and the complexity of the glowplug is reduced.

The technique needs just a few adaptable parameters and input quantities. Yet it provides a more accurate estimate than an estimate which is based on the glowplug power consumption alone.

According to the application, each glowplug can be modelled individually by providing individual parameters Cth, Rth, F for each glowplug. Individual estimates of the combustions chamber temperatures Tcc may also be used, for example depending on the individual positions of the pistons. Thus, a temperature spread due to glowplugs production spread and due to different cylinders fluid dynamics can be compensated for.

The improved temperature estimate provides several benefits. For example, the glow temperature can be reached more quickly while overheating is avoided, which leads to a prolonged lifetime of the glowplugs. Furthermore, a more accurate estimate of the glowplug temperatures makes it possible to use the supply energy more efficiently and to control the combustion process more accurately in order to reduce fuel consumption and emissions.

The improved glowplug temperature estimate can also be used for diagnostic purposes. A glowplug failure may be detected in time by comparison of the predicted glowplug temperature with an independent estimate of the glowplug temperature.

The embodiment is shown with a low voltage glowplug which is powered with a PWM method. In a further embodiment, which is not shown here, high voltage glow plugs are used and their power supply Pg is controlled in a similar way as shown before, for example by controlling the opening times of a glowplug relay. Furthermore, the power supply may also be controlled by regulating the supply current of the glowplug, e.g. by a variable resistor. In the latter case, the power supply to the glowplug can be estimated by current and/or voltage measurements instead of using the duration of opening and closing times of transistors or switches.

It is especially advantageous to use a method according to the application for a compression-ignition engine with an electronic fuel injection to provide an accurate control of the combustion process. However, the method may also be used for compression-ignition engines with a mechanical fuel injection or no fuel injection at all.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A method for controlling a glowplug of a compression-ignition engine, the method comprising:

determining a supplied power to the glowplug and a combustion chamber temperature;

predicting a glowplug temperature of the glowplug; and controlling a power supply to the glowplug using a predicted glowplug temperature, wherein the predicted glowplug temperature is derived from a numerical solution of a differential equation for the glowplug temperature, and wherein the differential equation for the glowplug temperature is nonlinear in the glowplug temperature.

2. The method according to claim 1, wherein the differential equation for the glowplug temperature is derived from a power balance equation comprising at least Pg, Pi, Pe, Pc, wherein Pg models the supplied power to the glowplug, Pi models an energy stored in the glowplug per unit of time, Pe models a radiation energy per unit of time, Pc models a heat energy per unit of time, the heat energy being transferred by convection or conduction.

3. The method according to claim 1, wherein the differential equation takes a form:

$$Pg(t)=A*d/dtTg(t)+B*Tg(t)+C*Tg(t)^4+D(t)$$

wherein Pg is a supplied energy to the glowplug, Tg is the glowplug temperature, A, B, C are derived from precalibrated values and D(t) is a function of the combustion chamber temperature.

4. The method according to claim 1, wherein the power supply to the glowplug is controlled by controlling an opening time of a glowplug relay.

5. The method according to claim 1, wherein the power supply to the glowplug is controlled by controlling an opening time of a transistor.

6. The method according to claim 1, wherein the combustion chamber temperature is derived from an engine coolant temperature.

7. The method according to claim 6, wherein the combustion chamber temperature is further derived from an engine load.

8. A device for controlling a glowplug temperature of a glowplug, comprising:

a derivation device adapted to derive a combustion chamber temperature;

a prediction device adapted to predict a predicted glowplug temperature from at least a supplied power to the glowplug and the combustion chamber temperature; and a controller adapted to control a power supply to the glowplug using the predicted glowplug temperature;

wherein the predicted glowplug temperature is derived from a numerical solution of a differential equation for the glowplug temperature, and wherein the differential equation for the glowplug temperature is nonlinear in the glowplug temperature.

9. The device according to claim 8, further comprising a second derivation device adapted to derive an amount of transferred heat energy, a heat energy being transferred by radiation transfer between the glowplug and a combustion chamber.

10. The device according to claim 8, further comprising a third derivation device adapted to derive a temperature control value for the glowplug temperature from the predicted glowplug temperature.

11. The device according to claim 8, further comprising a computational device adapted to compute a pulse width of a pulse width modulation from a temperature control value.

12. A non-transitory computer readable medium embodying a computer program product, the computer program product comprising:

a control program, the control program configured to control a glowplug of a compression-ignition engine, the control program further configured to:

determine a supplied power to the glowplug and a combustion chamber temperature;

predict a glowplug temperature of the glowplug; and control a power supply to the glowplug using a predicted glowplug temperature, wherein the predicted glowplug temperature is derived from a numerical solution of a differential equation for the glowplug temperature, and wherein the differential equation for the glowplug temperature is nonlinear in the glowplug temperature.

13. The computer readable medium embodying the computer program product to claim 12, wherein the differential equation for the glowplug temperature is derived from a power balance equation comprising at least Pg, Pi, Pe, Pc, wherein Pg models the supplied power to the glow plug, Pi models an energy stored in the glowplug per unit of time, Pe models a radiation energy per unit of time, Pc models a heat energy per unit of time, the heat energy being transferred by convection or conduction.

14. The computer readable medium embodying the computer program product to claim 12, wherein the differential equation takes a form:

$$Pg(t)=A*d/dtTg(t)+B*Tg(t)+C*Tg(t)4+D(t)$$

wherein Pg is a supplied energy to the glowplug, Tg is the glowplug temperature, A, B, C are derived from precalibrated values and D(t) is a function of the combustion chamber temperature.

15. The computer readable medium embodying the computer program product to claim 12, wherein the power supply to the glowplug is controlled by controlling an opening time of a glowplug relay.

16. The computer readable medium embodying the computer program product to claim 12, wherein the power supply to the glowplug is controlled by controlling an opening time of a transistor.

17. The computer readable medium embodying the computer program product to claim 12, wherein the combustion chamber temperature is derived from an engine coolant temperature.

18. The computer readable medium embodying the computer program product to claim 17, wherein the combustion chamber temperature is further derived from an engine load.

* * * * *